US007647680B2

(12) United States Patent
Dear

(10) Patent No.: US 7,647,680 B2
(45) Date of Patent: Jan. 19, 2010

(54) NOSE ASSEMBLY

(75) Inventor: Aiden Dear, Hitchin (GB)

(73) Assignee: Avdel UK Limited (GB)

( * ) Notice: Subject to any disclaimer, the term of this patent is extended or adjusted under 35 U.S.C. 154(b) by 550 days.

(21) Appl. No.: 11/687,250

(22) Filed: Mar. 16, 2007

(65) Prior Publication Data

US 2008/0222868 A1 Sep. 18, 2008

(51) Int. Cl.
*B21J 15/10* (2006.01)
*B23P 11/00* (2006.01)
*B23B 31/00* (2006.01)

(52) U.S. Cl. ..... 29/243.523; 29/243.522; 29/524.1; 72/391.4

(58) Field of Classification Search ..... 72/391.2, 72/391.4, 391.6, 391.8; 29/524.1, 243.521, 29/243.522, 243.523
See application file for complete search history.

(56) References Cited

U.S. PATENT DOCUMENTS 3,107,806 A * 10/1963 Van Hecke et al. ..... 29/243.522
5,357,666 A * 10/1994 El Dessouky et al. .. 29/243.521
6,449,822 B1 * 9/2002 Gilbert et al. ..... 29/243.521
7,178,213 B2 * 2/2007 Haas et al. ..... 29/243.523
7,530,155 B1 * 5/2009 Nikkel ..... 72/391.6

* cited by examiner

*Primary Examiner*—David B Jones
(74) *Attorney, Agent, or Firm*—Trexler, Bushnell, Giangiorgi, Blackstone & Marr, Ltd.

(57) ABSTRACT

A nose assembly for fitting onto a fastener installation tool for installing fasteners of the type in which a part of the fastener is broken off during the installation process, the nose being provided with a housing and a sleeve, the sleeve having a spring, and a collar which is movable within the housing against resistance of the spring, wherein plunger means are provided on the collar, and wherein the sleeve is threadably engaged with the collar, such that movement of the sleeve causes corresponding movement of the collar and plunger means, the plunger means being arranged to actuate a trigger thereby to open an air valve and allow a flow of compressed air through the tool, thereby to allow installation of the fastener into a workpiece.

8 Claims, 9 Drawing Sheets

NOSE ASSEMBLY

FIELD OF THE INVENTION

This invention relates to a nose assembly for a fastener installation tool of the type wherein parts of fasteners are broken off during installation of the fastener.

BACKGROUND OF THE INVENTION

Fastener installation tools can utilise a supply of compressed air, which is supplied to the tool and subsequently routed through a central bore within the tool head piston in order to propel broken off fastener stems into a collecting bottle at the rear of the tool. Compressed air is also routed through a vacuum generator to create a vacuum to hold the fastener in place in the tool nosepiece prior to installation. When an external trigger is pressed, actuation means cause a head piston to be driven along a bore to cause a jaw-assembly to grip and pull a fastener stem which has been inserted into the tool nosepiece The trigger also causes an air valve to open and allow air to flow through the tool to propel the broken off stem into the bottle.

Prior to installing a fastener, there is often a need to apply a preload to the workpiece, to ensure that the fastener is correctly engaged with and aligned in the aperture into which it is being installed, therefore ensuring that the fastener will be installed correctly once the tool is actuated. A further advantage of applying a preload to a workpiece is that the application of sufficient force ensures that workpiece components are held together prior to installation of the fastener, therefore also ensuring a secure fastener installation.

Known methods of applying a preload to a workpiece into which a fastener is to be installed include the use of nose assemblies. Known nose assemblies tend to be large in diameter and/or bulky, therefore providing restricted access to the workpiece. Furthermore, adapters are required for both the tool and the piston rod.

It is an aim of the present invention to provide a standardised sensitive nose assembly which can be used for installation of various sizes of fastener and which can be fitted to an installation tool without the need for adapters.

SUMMARY OF THE INVENTION

In a first aspect, the invention provides a nose assembly for a fastener installation tool as claimed in claim 1 of the appended claims.

An advantage of the present invention is that a preload is applied to the workpiece, and a fastener can only be installed once it is in the correct position and the leading face of the nose assembly is flush with the workpiece. A further advantage is that the nose assembly, which can be serially manufactured, is standardised and can be easily fitted to an installation tool without the use of adapters.

Preferably, a first locknut is provided which can maintain the position of the sleeve relative to the collar. A first level of adjustment is thereby provided, wherein the sleeve can be adjusted and subsequently locked in position by the first locknut. A second locknut can also be provided, which can maintain the position of the screw relative to the internally threaded arm. A second level of adjustment is thereby provided, wherein once the sleeve has been locked in position relative to the collar, the screw can be adjusted as required to ensure the plunger means will actuate the extension trigger valve as intended. The screw can be subsequently locked in position by the second locknut.

The first level of adjustment allows the position sleeve and therefore the amount of preload applied to the workpiece, to be adjusted in accordance with the size of the head of the fastener which is to be installed. For larger (thicker) fastener heads, the sleeve must be further out of the collar, and accordingly the screw further out of the internally threaded arm, than for smaller heads, and therefore the preload reached before the extension trigger is actuated is higher.

The plunger means may be arranged to be used in conjunction with the tool trigger 66, such that the tool trigger must be pressed to actuate the tool. However, the plunger means may be further arranged as the sole actuation means by which a fastener is installed. The actuation of the tool to install a fastener is therefore automatic once the sleeve has been depressed sufficiently into the housing to cause the plunger means to operate, and there is no requirement for a normal tool trigger to actuate the tool.

The housing of the nose assembly may include a cavity to allow a trigger to be moved into a position wherein the flow of air to the vacuum generator is halted, to prevent wastage when the tool is not being used.

Preferably the nose assembly includes location pins, provided on the housing, to ensure that, on fitting the nose assembly to the tool, the assembly is correctly orientated in relation to the tool. The nose assembly may be secured to the tool by retaining screws.

The plunger means is preferably located in a separate extension attached to the housing of the nose assembly, wherein the extension extends further from a centre line of the tool (the centre line of the bore through which the fasteners are installed) than the housing. Therefore the obstruction caused by the nose assembly is minimised, and access to the workpiece during installation is maximised.

In a second and third aspect, the invention also provides methods for installing a fastener as claimed in claims 7 and 8 of the appended claims.

BRIEF DESCRIPTION OF THE DRAWINGS

The foregoing and other features and advantages of the present invention will become more readily appreciated as the same becomes better understood by reference to the following detailed description when taken in conjunction with the accompanying drawings in which.

DESCRIPTION OF THE PREFERRED EMBODIMENTS

Figure 1:
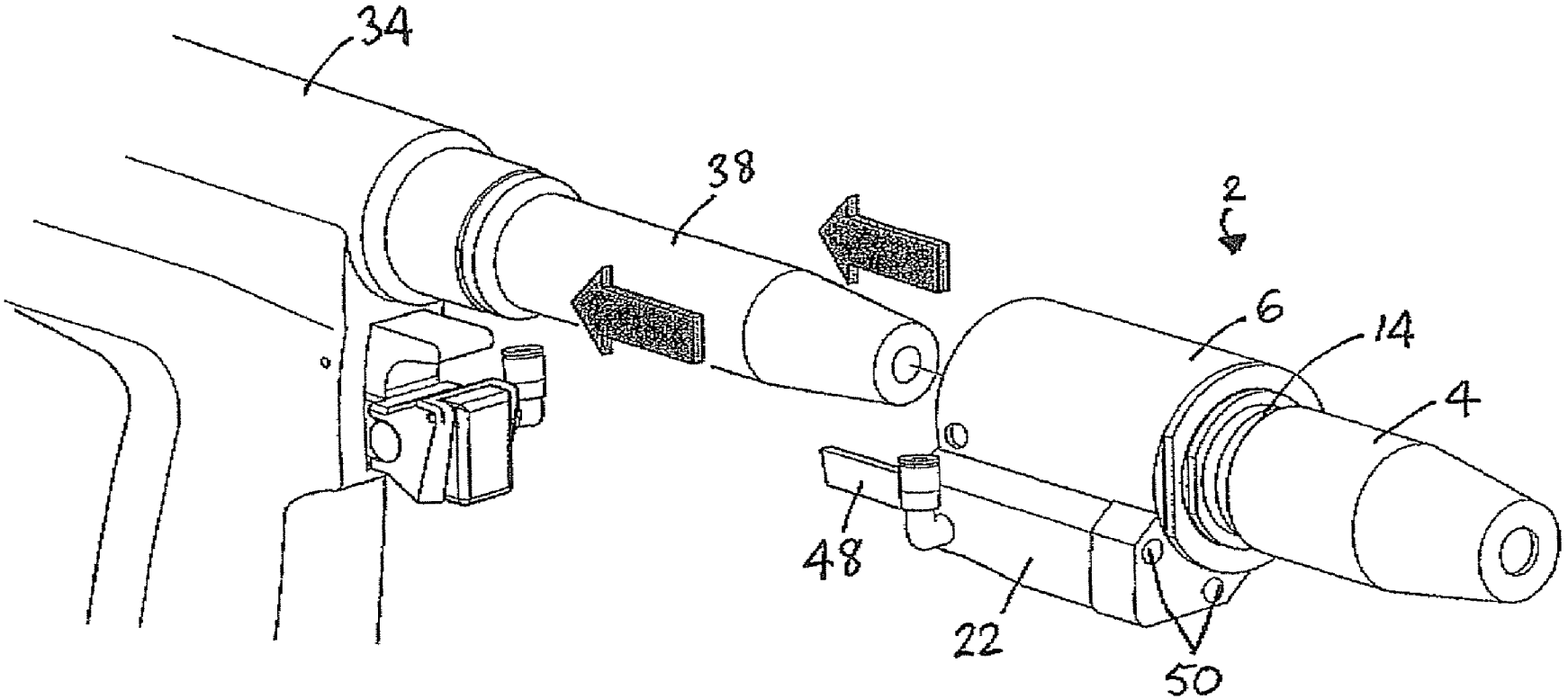
FIG. 1 is a perspective view of a nose assembly in accordance with the present invention being fitted onto a fastener installation tool.
Figure 2:
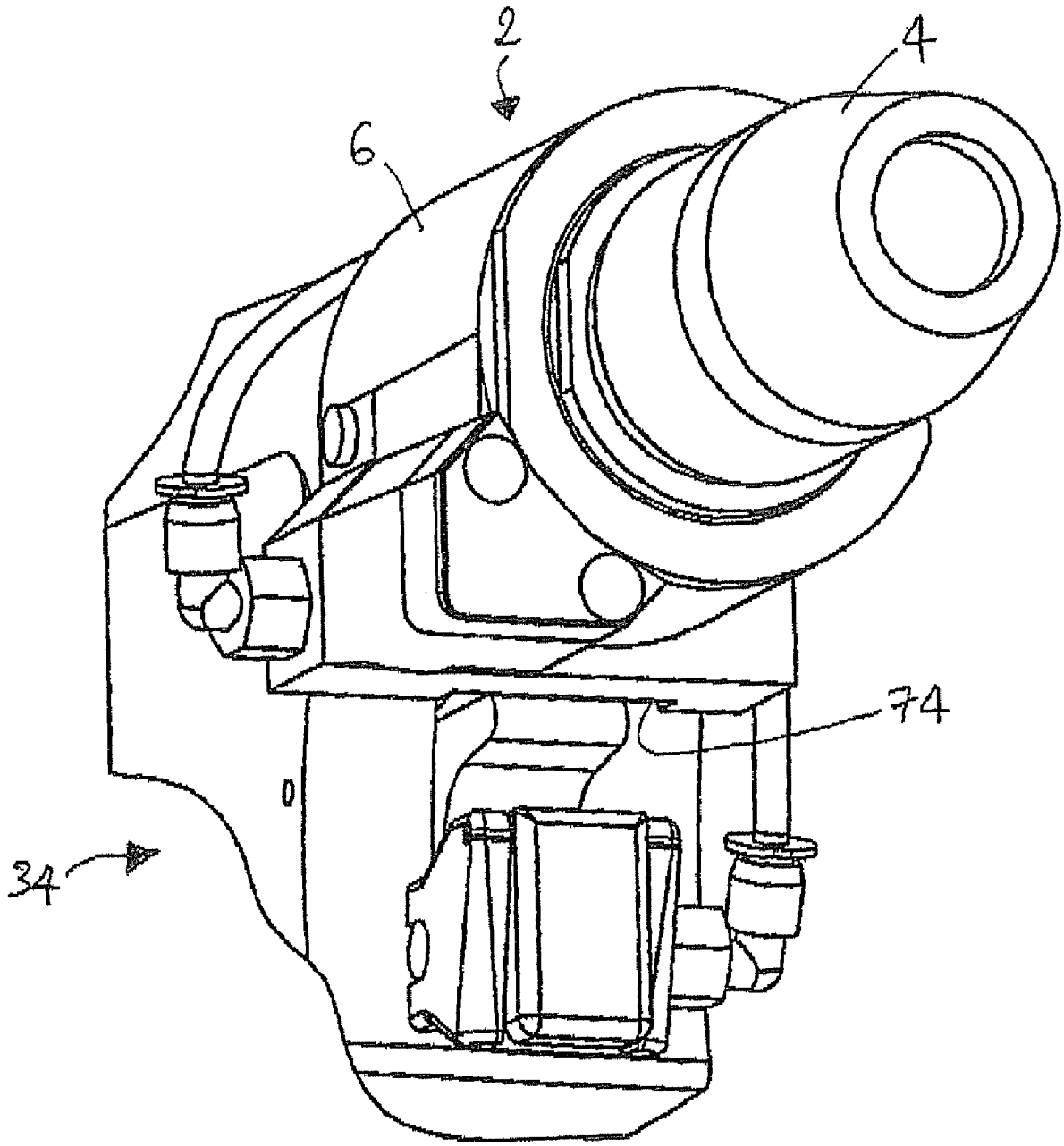
FIG. 2 is a partial perspective view of the nose assembly of FIG. 1 fully fitted onto a fastener installation tool.
Figure 3:
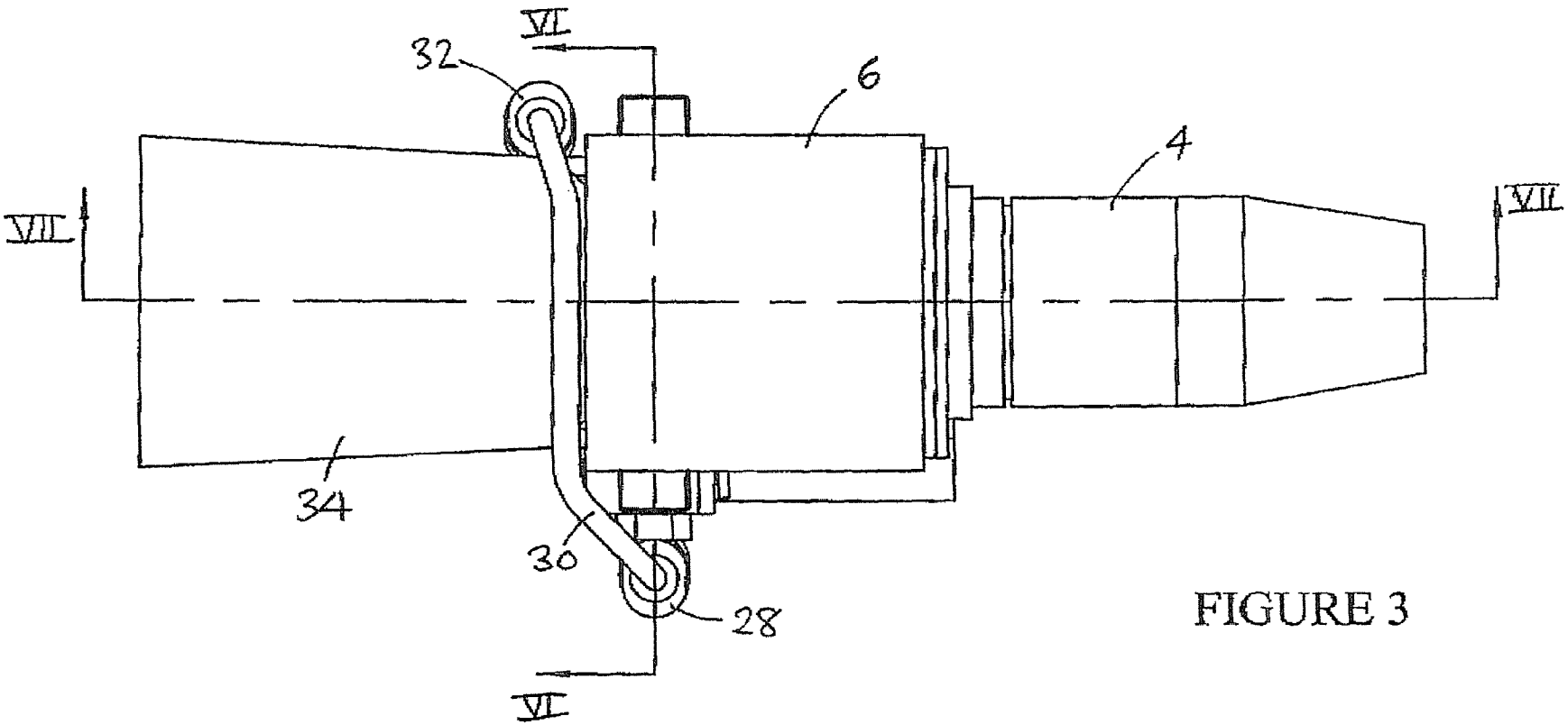
FIG. 3 is a plan view of the nose assembly and tool of FIG. 2.
Figure 4:
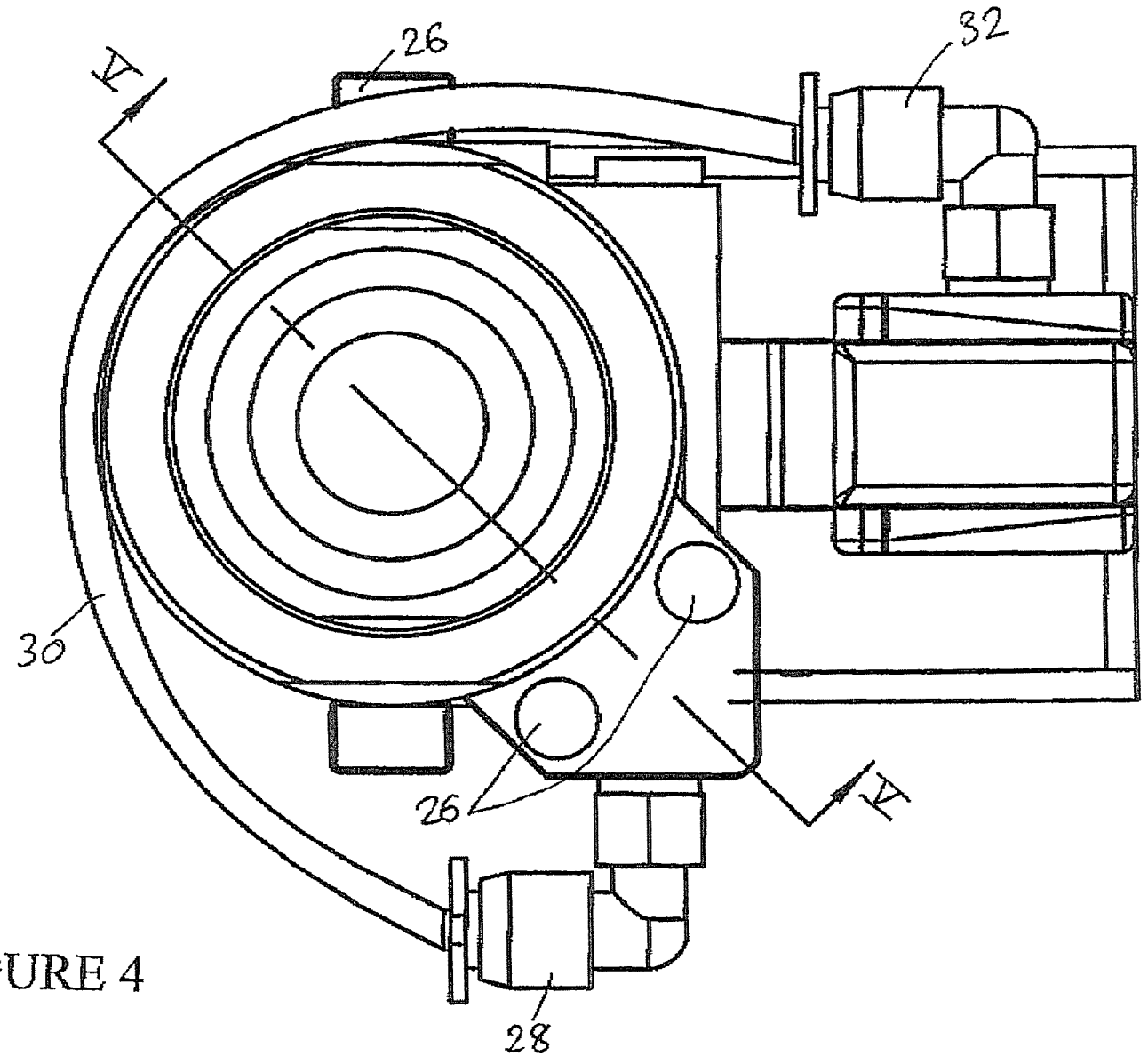
FIG. 4 is an end view of the nose assembly and tool of FIG. 2.
Figure 5:
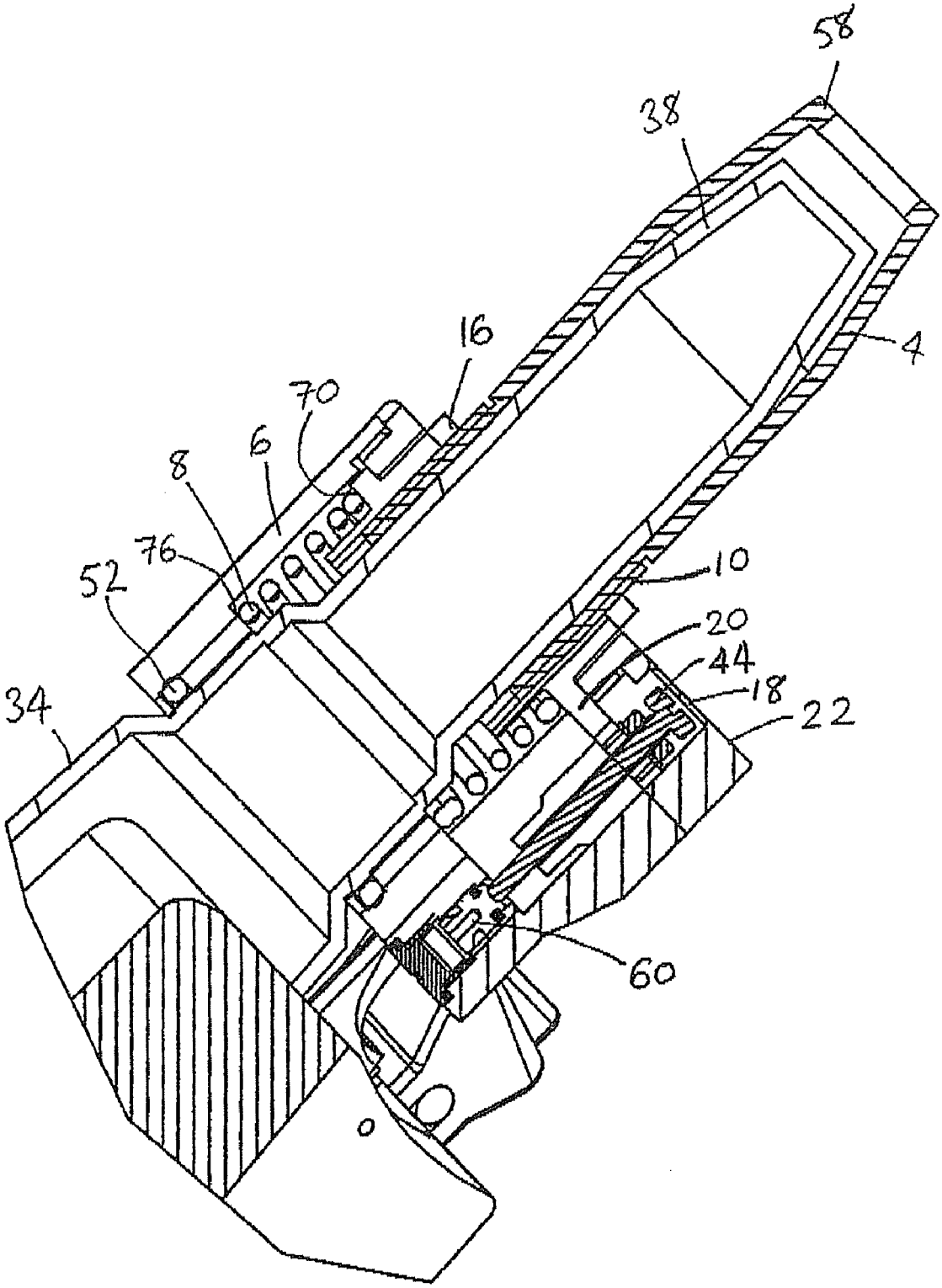
FIG. 5 is a longitudinal cross section of the nose assembly and tool of FIG. 4 along the line V-V.
Figure 6:
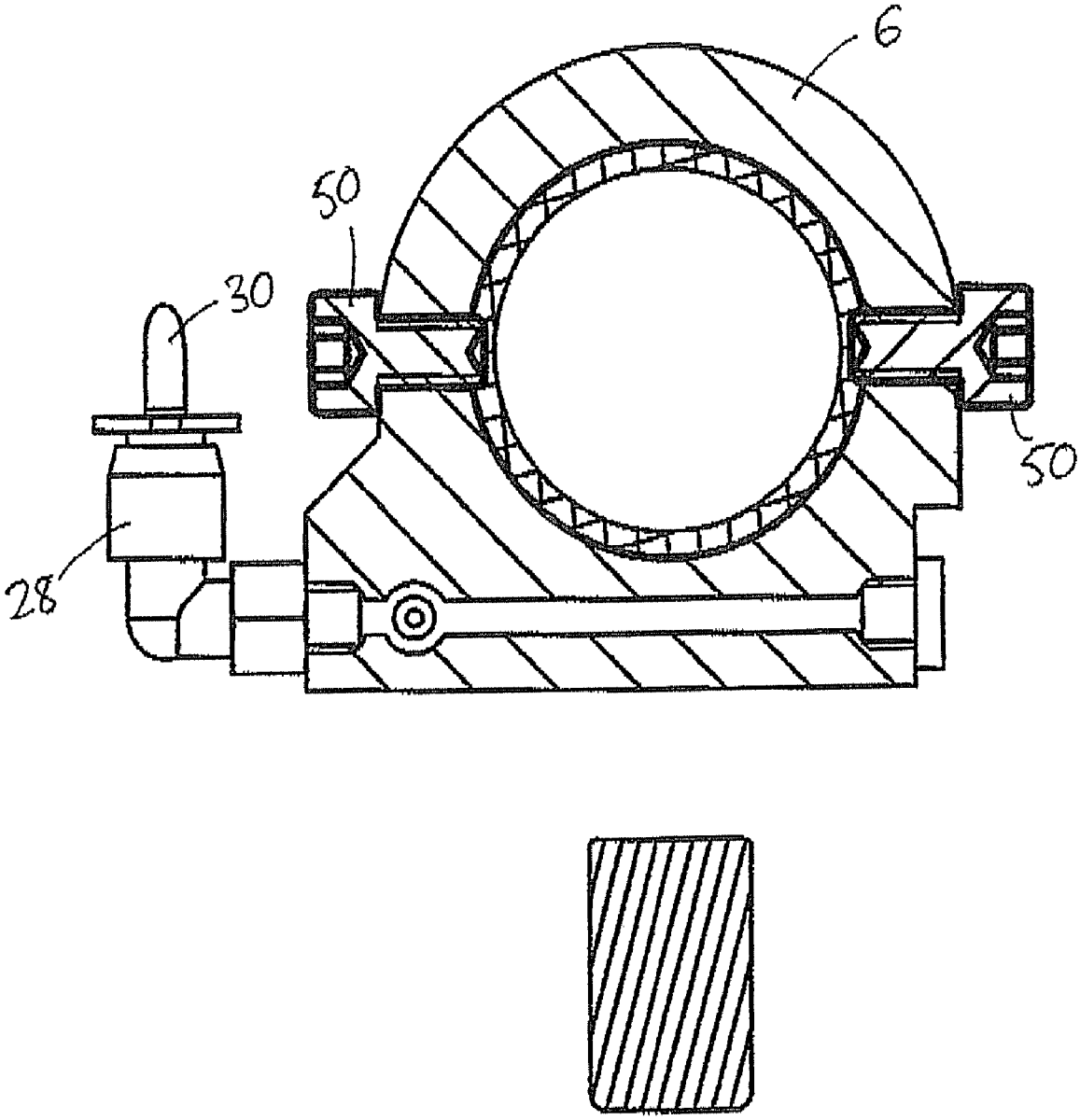
FIG. 6 is an axial cross section of the tool and nose assembly of FIG. 3 along the line VI-VI.
Figure 7:
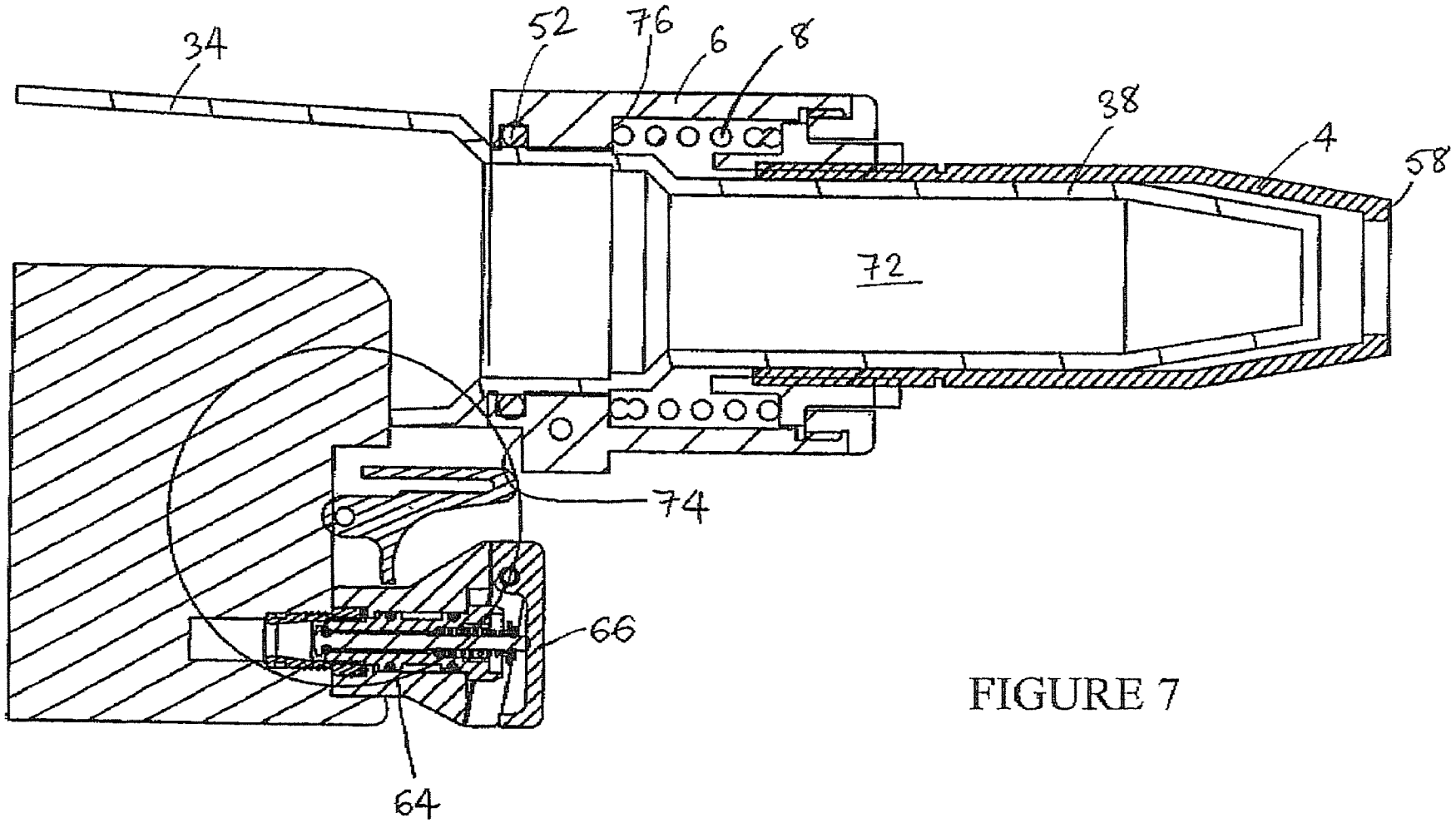
FIG. 7 is a longitudinal cross section of a nose assembly and tool of FIG. 3 along the line VII-VII.

Referring to FIG. 1, the nose assembly 2 comprises a sleeve 4 and a housing 6. As shown in FIG. 5, the housing 6 houses a compression spring 8, and a collar 10. Collar 10 is provided with an internal thread (not shown), and is movable within the housing 6 against the compression of the spring 8. An external thread 14 (FIG. 1) provided on the sleeve 4 engages with the collar thread 12, and a first locknut 16 is provided on the sleeve thread 14 between the sleeve 4 and the housing 6. The threads 12, 14 and first locknut 16 allow a first level of adjustment of the assembly, by allowing the sleeve 4 to be threaded in to the collar 10 as far as necessary (according to the size of the head of the fastener which is to be installed) and subsequently locked in position by the first locknut 16.

Referring to FIG. 5, a plunger means 18 is attached to the sleeve 4 via an arm 20, such that movement of the sleeve 4 within the housing 6 causes corresponding movement of the plunger means 18. An extension 22, is attached to the housing 6, and a longitudinal slot (not shown) is provided within the housing 6 such that the plunger means 18 protrudes beyond the housing 6 into the extension 22. Therefore the extension extends further from a centre line of the tool (through the central bore 72) than the housing 6.

The extension 22 is secured to the housing 6 by retaining screws 50. The extension 22 further includes an first air inlet 28, which is connected by tubing 30 to a second air inlet 32 inlet provided on the tool 34. Therefore when an air supply (not shown), connected to the tool 34, is switched on to cause a vacuum within the tool 34 to maintain a fastener 36 within the tool nosepiece 38, air is also provided to a trigger valve 64 and within the tubing 30. Alternatively air is supplied to the rear of the trigger assembly and upon operation of the tool trigger 66, to tubing 30.

The plunger means 18 comprises an internally threaded arm 40, and a screw 44 which is screwed into internally threaded arm 40. A second level of adjustment, in accordance with the head size of the fastener to be installed, is provided by varying the extent to which the screw 44 is screwed into the arm 40. A second locknut 46 is provided between the screw 44 and the arm 40 to lock the screw 44 in position relative to the arm 40 once the screw 44 has been inserted to the required extent.

The nose assembly 2 is fitted onto the tool 34 by sliding the assembly over the nosepiece 38. Location pins 48 are provided on the housing 6 ensure correct rotational orientation of the assembly 2 with respect to the tool. Retaining screws 50 are provided to secure the assembly 2 to the tool 34, and an 0 ring seal 52 is provided between the housing 6 and the tool 34.

Figure 9:
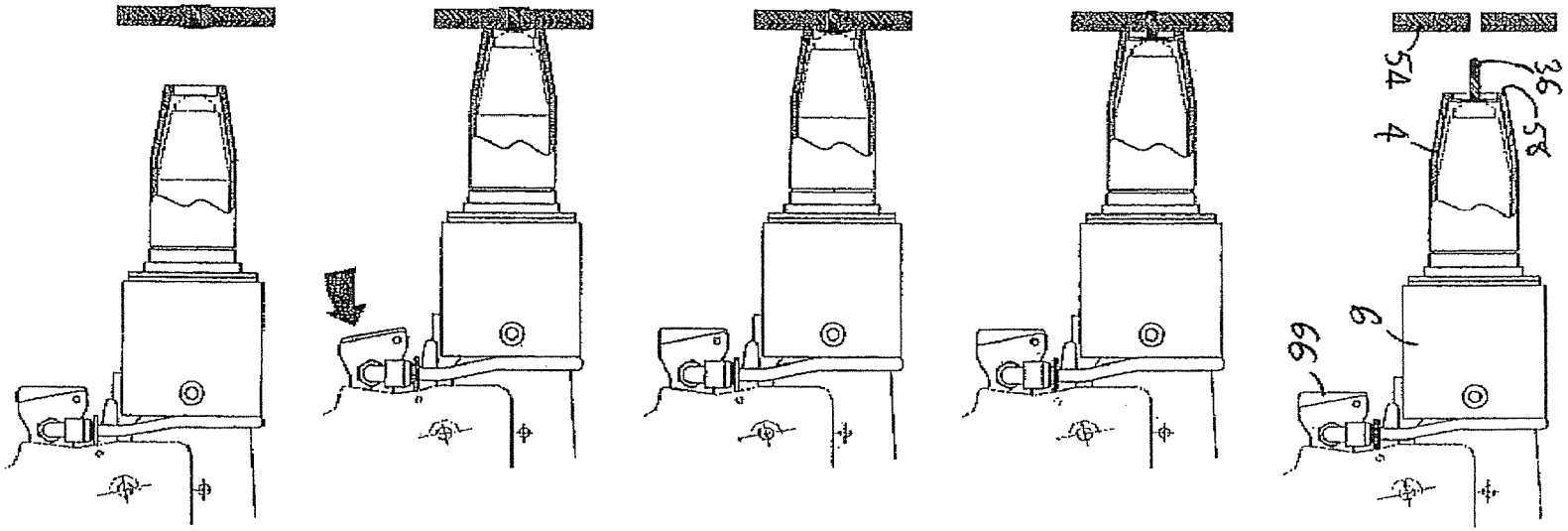
FIG. 9 is a diagrammatic representation of the sequence of steps to install a fastener using a tool fitted and a nose assembly of FIG. 2.

As illustrated in FIG. 9, prior to the installation of a fastener 36 into a workpiece 54, the tool 34 is aligned with the aperture 56 into which the fastener 36 is to be installed, and the fastener 36 is inserted into the aperture 56 until the leading face 58 of the nose assembly sleeve 4 contacts the workpiece 54. When the tool 34 is pressed against the workpiece 56, a force is applied to the leading face 58. This force is transmitted to the collar 10 via the threads 12, 14, and thereby to the compression spring 8, via an annular shoulder 70 provided on the collar 10. The compression spring 8 provides resistance to the movement of the sleeve 4 inwardly into the housing 6, thereby applying a pre-load to the workpiece 54. Once the force with which the tool 34 is pressed into the workpiece 54, and therefore the force applied to the leading face 58, exceeds the resistance of the spring 8, the sleeve 4 is caused to be pushed inwardly into the housing 6, thereby causing corresponding movement of the collar 10, extension 22, arm 40 and screw 44.

Inward movement of the screw 44 causes it to contact a piston 60, which acts as an extension trigger valve. The actuation of the extension trigger valve and the tool trigger 66 thereby causes activation of the actuation means by which the fastener is installed. The flow of air through the tool and the vacuum generator causes the stem of the fastener which is broken off during installation to be ejected into the collection bottle (not shown).

A cavity 74 is provided in the housing 6, to enable a trigger to be moved into a position wherein the flow of air to the vacuum generator is halted to prevent wastage.

Figure 10:
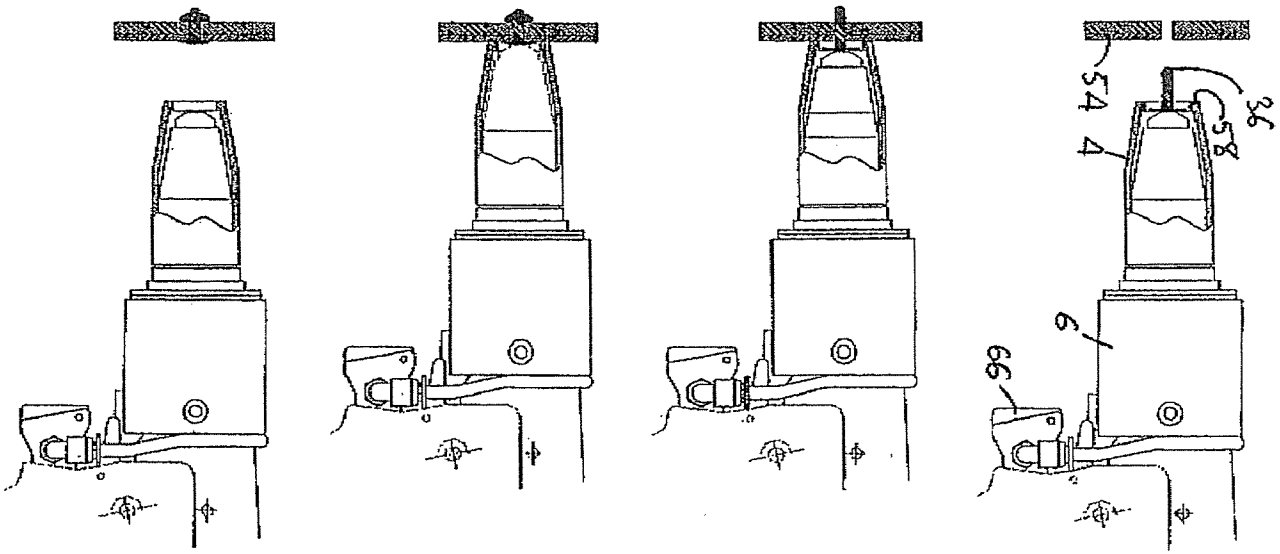
FIG. 10 is a diagrammatic representation of the sequence of steps to install a fastener using the tool and nose assembly of FIG. 8.

In the alternative embodiment shown in FIGS. 10 and 12, the extension trigger is arranged also to cause activation of the actuation means to install a fastener. Therefore actuation of the extension trigger causes both the flow of air through the tool, and simultaneous actuation of the tool 34 to install the fastener 36 into the workpiece 54. As the tool trigger 66 is not required for actuation of the tool when this embodiment of sleeve assembly is used, the tool trigger valve is replaced with a blanked trigger valve 68.

Figure 8:
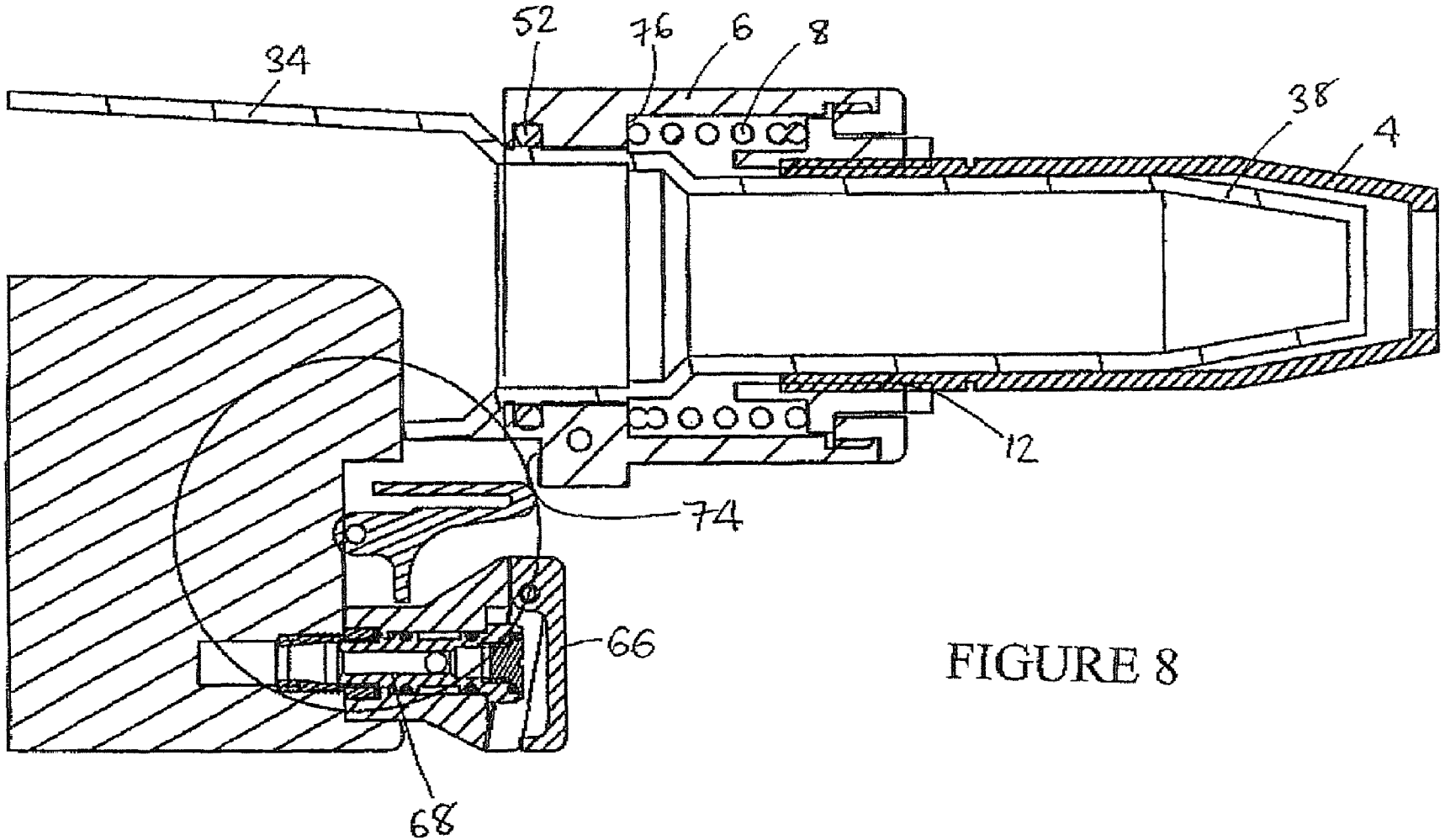
FIG. 8 is a longitudinal cross section of a tool fitted with an alternative embodiment of nose assembly in accordance the present invention.

A cavity 74 is also provided in the embodiment of FIG. 8, enabling a trigger to be moved into a position wherein the air flow to the vacuum generator is halted.

Spacers may be positioned between the compression spring 8 and a shoulder 76 of the assembly housing 6 to increase the preload applied to the workpiece 54. Alternative springs may be fitted to further adjust and control the preload.

In an alternative embodiment, the nose assembly could be secured to the tool by a pinch bolt assembly. In this embodiment, slits are provided in the housing of the assembly, to provide sufficient resilience to allow the pinch bolt assembly to be tightened thereby securing the assembly to the tool.

What is claimed is:

1. A nose assembly for a fastener installation tool for installing fasteners of the type in which a part of the fastener is broken off during the installation process, said nose assembly comprising a housing and a sleeve, said housing being provided with a spring, and a collar which is movable within the housing against resistance of the spring, wherein plunger means are provided on the collar, and wherein the sleeve is threadably engaged with the collar such that movement of the sleeve causes corresponding movement of the collar and plunger means, the plunger means being arranged to actuate a trigger thereby to open an air valve and allow a flow of compressed air through the tool.

2. A nose assembly as claimed in claim 1 wherein a first locknut is provided to maintain the sleeve in position relative to the collar, thereby providing a first level of adjustment, and wherein the plunger means comprises an internally threaded arm, a screw which is insertable into the arm, and a locknut which is actuable to maintain the screw in position relative to the arm, thereby providing a second level of adjustment.

3. A nose assembly as claimed in claim 1 wherein the plunger means is further arranged to activate actuation means to install a fastener.

4. A nose assembly as claimed in claim 1 wherein an cavity is provided in the housing to allow a trigger to be moved into a position wherein air flow to a vacuum generator is disabled.

5. A nose assembly as claimed in claim 1 wherein location pins are provided on said housing to orientate the nose assembly relative to the tool, and retaining screws are provided to secure the nose assembly to the tool.

6. A nose assembly as claimed in claim 1 wherein the plunger means is disposed in an extension which extends further from a centre line of the tool than the housing.

7. A method of installing a fastener into an aperture in a workpiece using an installation tool provided with a nose assembly, said nose assembly having a housing and a sleeve engaged with a collar disposed within the housing, said method comprising steps of:

(a) aligning said sleeve with said aperture such that a leading face of the sleeve contacts said workpiece;

(b) pressing the sleeve against the workpiece, thereby causing the sleeve to be pushed inwardly into said housing, and thereby causing the collar to be pushed inwardly into the housing against the resistance of a spring, thereby causing a plunger means attached to said collar to actuate an extension trigger to open an air valve and allow a flow of air through the tool, and (c) pressing a tool trigger to activate actuation means to cause said fastener to be installed into said aperture.

8. A method of installing a fastener into an aperture in a workpiece using an installation tool provided with a nose assembly, said nose assembly having a housing and a sleeve engaged with a collar disposed within said housing, said method comprising steps of:

(a) aligning said sleeve with the aperture such that a leading face of the sleeve contacts said workpiece; and (b) pressing the sleeve against the workpiece, thereby causing the sleeve to be pushed inwardly into said housing, and thereby causing the collar to be pushed inwardly into the housing against the resistance of a spring, thereby causing a plunger means attached to said collar to actuate an extension trigger to open an air valve and allow a flow of air through the tool, wherein the actuation of the extension trigger activates actuation means to cause installation of said fastener.

* * * * *